United States Patent [19]

Walter

[11] 4,299,330

[45] Nov. 10, 1981

[54] CONTAINER CLOSURE DEVICE

[75] Inventor: John Walter, Evergreen Park, Ill.

[73] Assignee: The Continental Group, Inc., Stamford, Conn.

[21] Appl. No.: 81,593

[22] Filed: Oct. 3, 1979

[51] Int. Cl.[3] ..... B65D 41/04
[52] U.S. Cl. ..... 220/288; 215/329
[58] Field of Search ..... 215/329, 31, 217, 354; 220/288

[56] References Cited

U.S. PATENT DOCUMENTS 3,167,202 1/1965 Tolciss ..... 220/288 X
4,098,419 7/1978 Virog, Jr. et al. ..... 215/329

FOREIGN PATENT DOCUMENTS 500938 2/1951 France ..... 215/329

*Primary Examiner*—George T. Hall
*Attorney, Agent, or Firm*—John J. Kowalik

[57] ABSTRACT

A novel connection for a thermoplastic neck to a stub neck portion of a container, comprising a curl on the stub neck portion and a complimentary groove on the neck which cooperate to permit a portion of the neck below the curl to expand when a plug of the closure cap, which is threaded onto the neck, is inserted into the neck. The neck and neck portion have interlocking projections to prevent the neck from turning and the neck and cap having a novel thread arrangement which insures that the plug will properly enter into the neck and provide a good seal which could be frustrated if the neck was permitted to turn.

7 Claims, 7 Drawing Figures

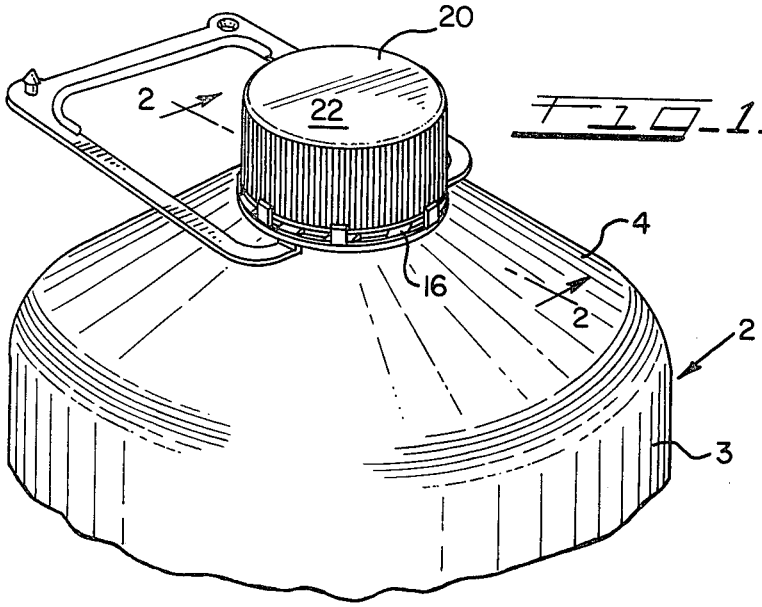
FIG. 1
FIG. 7
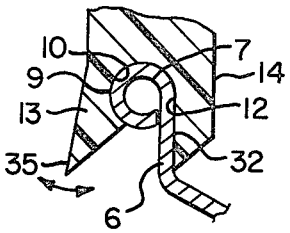
FIG. 2
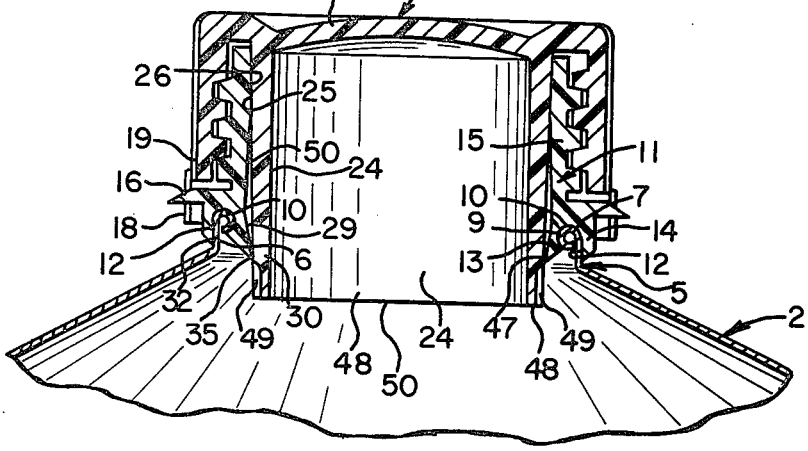

FIG. 3
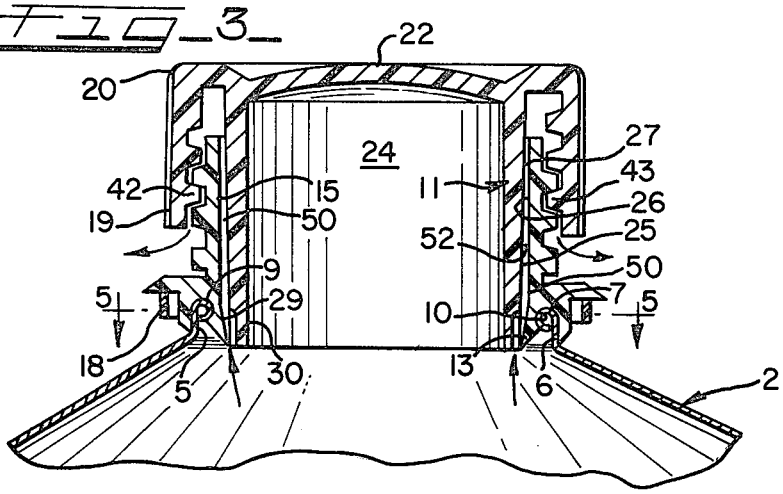
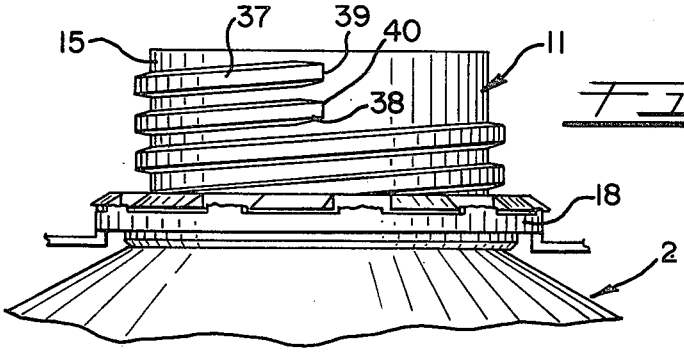
FIG. 4
FIG. 5
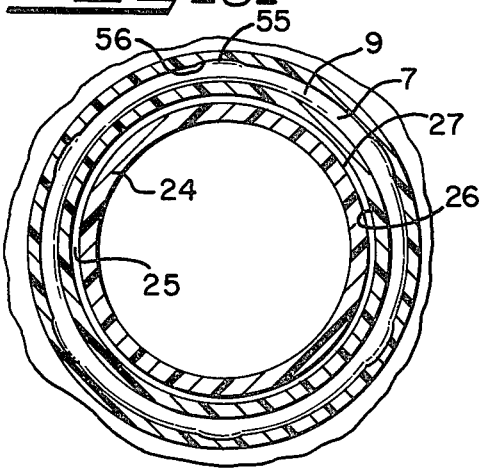
FIG. 6
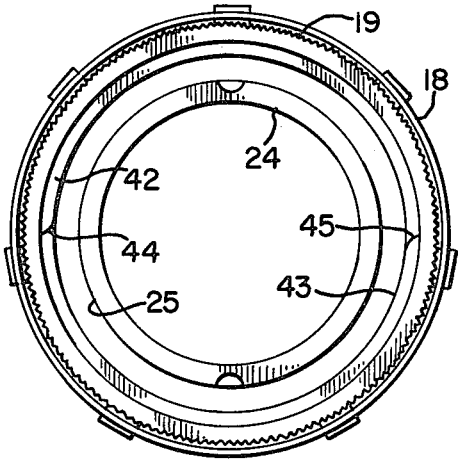

CONTAINER CLOSURE DEVICE

DESCRIPTION OF THE INVENTION

This invention appertains to a closure for a metal container in which a thermoplastic neck number is fitted onto a stub neck portion of the container, said neck portion having an inturned curl which provides smooth upper, inner and lower annular surfaces which mate with a similar surface in a groove at the inner end of a slot formed at one end of the neck member. The outer side of the curl has radially outwardly extending projections which imbed into an outer slot-defining flange portion of the neck member. The outer flange is deformed when the neck member is heat-softened prior to application to the stub neck of the container. At such time, the groove in the inner end of the slot also reforms and then conforms to the shape of the curl so as to provide a hermetic seal. The neck also has a bore with a narrow inner end which is tapered downwardly into which the plug of the cap is wedged when the cap is threaded onto the neck member. To insure that the plug enters true with respect to the bore and thus properly wedges into the narrow frustoconical surface at the lower end of the bore, double threads are provided on the neck and cap, the pair of threads on the cap being formed on the interior of the skirt of the cap and the leading end of each such thread is offset 180° from the leading end of the other thread. The double threads on the neck have their leading ends in axial alignment with each other and thus the cap is only turned a small distance before the threads engage. The invention also provides a novel neck portion with an inturned curl which effects a novel hermetic seal with the plastic neck extrusion.

DISCUSSION OF THE PRIOR ART

Various types of connections of plastic neck members to a container are known. These connections are normally made while the neck member is at ambient temperature and are snap fits. Such connections, even when tight, rotate frequently. They are difficult to apply or remove the cap threaded onto such rotating neck member. Also in pressurized containers to which the present invention is applicable, a poor seal is obtained. Such closures usually comprise a cap with a plug which wedges into the container neck portions. Any difficulty experienced in applying the cap to the neck portion may cause the cap to cant on the neck portion and thus cause the plug to enter at an angle into the neck bore and provide a poor seal.

SUMMARY OF THE INVENTION

This invention is directed to a novel assembly of a neck and cap to a container which is easy to manufacture and assemble.

A general object is to provide a novel stub neck configuration on the metal container which provides a good seal with the plastic neck member and which interlocks the neck member to the stub neck to prevent relative rotation.

A further object is to provide a novel cap and neck member assembly wherein the cap and neck member are accurately guided into a tight sealing relation and in which the neck member is provided with an axial slot which receives a stub neck portion of a container therein, the slot being defined by inner and outer flanges and the stub neck portion having an inturned curl at its upper end which is embraced by the neck flanges, the inner flange having a wedge fit with a plug on a closing cap such that during closure, the inner flange is cantilevered against the curl and spread radially outwardly below the curl, thus effecting a good seal and concurrently drawing the outer flange tightly against the external side of the stub neck and embedding the same between projections found on the neck.

A further object is to provide such neck member, cap and stub neck portion assembly in which the parts cooperate to seal the cap to the neck member and to seal the neck member to the stub neck.

FIG. 1 is a fragmentary perspective view of a container incorporating the invention, FIG. 2 is a vertical cross-section view taken substantially on the line 2—2 of FIG. 1 on an enlarged scale, FIG. 3 is a view similar to FIG. 2 showing the cap partially unthreaded, FIG. 4 is a fragmentary side-elevation view of the upper portion of the container with the neck applied thereto, FIG. 5 is a cross-section view taken substantially on the line 5—5 of FIG. 3, and FIG. 6 is a bottom view of the cap.

FIG. 7 is an enlarged portion of FIG. 2 shown in the circle.

DESCRIPTION OF THE INVENTION

The invention is shown applied to a metal container generally designated 2, which has a domed upper end 4 and a body 3 has a closed bottom end, not shown. The upper end of the domed upper end portion 4 is formed with a stubbed neck generally designated 5 comprising an annular wall 6 terminating in a C-shaped curl or rim 7 at its upper end.

The curl 7, which is inturned, provides a smooth upper, inner and bottom annular surface 9 which fits complementally into a groove 10 in the lower end of a plastic neck member generally designated 11, the groove 10 is formed at the upper end of a slot 12 which is defined by inner and outer axially extending flange members 13 and 14 which flank the wall 6. Flange members 13 and 14 are formed integral with an upper threaded portion 15 of the neck member. A series of teeth 16 are provided about the lower end of the upper portion 15 of the neck member which cooperate with a pilfer-indicating band 18 which is connected to the lower end of a skirt 19 of a cap, generally designated 20.

The cap 20 is provided with a top wall 22, from which depends a plug 24 having a frusto-conical tapered outer wall surface 25 which cooperates with a surface 26 of the bore 27 of the neck member. The lower end portion of the bore 27 is of reduced diameter and has a frusto-conical sealing surface 29 which tapers downwardly or inwardly of the container and which cooperates with the lower end portion 30 of the plug 24 which wedges into the lower end portion of the bore and expands the flange 13 as shown in FIG. 3 from that shown in FIG. 2, thus cantilevering the portion 13 about the surface 9 and drawing the portion 14 tightly against the cylindrical outer surface 32 of the stub-neck wall 6.

In order to apply uniform pressure about the entire circumference of the lower portion 29 and particularly at the section 35 thereof, it is necessary that the plug or post or stem 24 be prevented from canting within the bore and extend in true axial alignment with the axis of the bore. To this end, there are provided on the neck portion 15 double spiral threads 37, 38 which have coaxial terminal ends 39 and 40. The cap is provided with dual threads 42, 43, thread 42 having its leading end 44 offset 180° from the leading end 45 of the thread 43. Thus, upon application of the cap to the neck member, the cap properly aligns with the neck member so that it is not canted. In this respect, it will be observed that the proper sealing is obtained between the upper section 47 of the lower portion 48 of the plug and the section 35 of the neck member. It will be noted that as the cap is unthreaded from the position shown in FIG. 2, the cap elevates and axially extending slots 49 in the plug which terminate at their upper ends below the portion 47 and extend to the lower end 50 of the post 24 will assume the position shown in FIG. 3. At this time the skirt of the cap will be interthread with the threads on the neck and the high pressure gas contained within the container will bleed off through the slots 49 into a space 50 between the periphery 25 of the post and the bore surface 26. The gases will then pass over the top of the neck member to between the threads and then dissipate into the atmosphere.

It will be apparent from the description that a novel cap and neck assembly has been provided and its attachment to the stub neck portion of the metal container.

It will be understood that the neck member may be made of polyethylene, polypropylene or other similar plastic resin material, which for application to the stub neck of the container, is heated to a softening temperature and while in its softened state, is positioned to extend the stub neck portion 6 into the slot between the inner and outer flanges 12 and 13 until the curl snaps into the groove 7. At the same time, the outer side of the curl portion, which is formed with outward projections or bumps 55, will form depressions 56 in the outer flange member 14, by the same thus pocketing the bumps of projections 55 within the pockets 56. When the material cools ambient temperature, it hardens. A novel simple interlock is thus obtained between the neck member and the stub necked portion of the container preventing rotation of the neck portion during application or withdrawal of the cap with respect to the neck member.

Having described the preferred embodiment of the invention, it will be apparent that other modifications will become apparent within the scope of the appended claims.

I claim:

1. A cap and neck assembly of thermoplastic material, the neck of said assembly comprising a pair of interdigitated spiral threads having leading ends terminating in a common location on the periphery of said neck and offset upwardly from the remaining threads and a cap having a pair of threads arranged to engage respective threads on said neck, said threads on said cap having leading end portions offset circumferentially from each other.

2. The invention according to claim 1 and said cap having a skirt portion and said threads on the cap formed in said skirt and having leading ends offset 180° from each other.

3. The invention according to claim 1 and said leading ends of said thread being located in a common radial plane on said cap.

4. The invention according to claim 1 and said cap having a plug, and said neck having a bore with a constricted inner end into which said plug is adapted to be wedged, said thread arrangement being such as to guide the cap to position said plug in true alignment with said bore and uncanted into said constricted portion of said bore.

5. A closure for a high pressurized container having a plastic neck member comprising a bore with a downwardly tapered frusto-conical lower end portion, a cap having a top wall and a tapered plug depending therefrom adapted to fit loosely in the bore and wedge tightly into said tapered lower end portion in sealing position therewith, said cap having a skirt, and said skirt and neck member having a pair of threads on each thereof meshing with the complimentary pair of threads on the other thereof, and said threads being arranged to allow screwing off of the cap sufficiently to withdraw the plug from sealing position to to allow escape of pressurized gases before the cap can be unscrewed sufficiently to cause it to blow off.

6. The invention according to claim 5 and said threads being arranged to cause said cap to thread on evenly onto the neck and thus to accurately position the plug in said bore.

7. The invention according to claim 6 and said neck a member having a connection with said container including projections on a portion of the container in interlocking engagement with the neck member to prevent rotation of the neck member during application and removal of the cap therefrom.

* * * * *